US006978712B2

(12) United States Patent
Baugh

(10) Patent No.: US 6,978,712 B2
(45) Date of Patent: Dec. 27, 2005

(54) VARIABLE DISPLACEMENT PISTON TYPE PUMP

(76) Inventor: Benton F. Baugh, 14626 Oak Bend, Houston, TX (US) 77079

( * ) Notice: Subject to any disclaimer, the term of this patent is extended or adjusted under 35 U.S.C. 154(b) by 416 days.

(21) Appl. No.: 10/445,402

(22) Filed: May 27, 2003

(65) Prior Publication Data

US 2004/0241007 A1 Dec. 2, 2004

(51) Int. Cl.[7] ..... F04B 13/00
(52) U.S. Cl. ..... 92/13; 92/168; 92/186; 277/558; 74/831
(58) Field of Search ..... 92/13, 13.1, 168, 92/186; 74/828, 831; 277/558, 929

(56) References Cited

U.S. PATENT DOCUMENTS

| | | | | |
|---|---|---|---|---|
| 1,292,457 | A * | 1/1919 | Hall | 92/13.1 |
| 2,898,867 | A * | 8/1959 | Saalfrank | 92/13.1 |
| 3,443,521 | A * | 5/1969 | Stender | 92/13.1 |
| 4,222,575 | A * | 9/1980 | Sekiguchi et al. | 277/558 |
| 4,264,281 | A * | 4/1981 | Hammelmann | 92/13.1 |
| 4,384,576 | A * | 5/1983 | Farmer | 92/13.1 |
| 4,681,515 | A * | 7/1987 | Allen | 92/13.1 |
| 6,928,922 | B2 * | 8/2005 | Nagai et al. | 92/168 |

* cited by examiner

*Primary Examiner*—Michael Koczo, Jr.

(57) ABSTRACT

A method of providing variable pumping rate from a piston type pump at a constant drive speed, comprising providing a connecting rod connected to the throw of a crankshaft on one end and to a connecting pin on the other end, constraining said connecting pin to move reciprocally generally in a first direction when said crankshaft rotates, a piston connected to said connecting pin which is mounted in a head and moves reciprocally in a second direction, and varying the angle between said first direction and said second direction to vary the volume being pumped by said pump.

24 Claims, 5 Drawing Sheets

VARIABLE DISPLACEMENT PISTON TYPE PUMP

BACKGROUND OF THE INVENTION

The field of this invention of that of crankshaft driven pumps which are used to produce pressurized fluid, typically at relatively high pressures. A conventional crankshaft driven pump has a crankshaft, connecting rod, and piston very much like an automotive engine. It will typically have an intake valve for each cylinder to draw fluid into the cylinder area on the "down stroke" of the piston, or the portion of the stroke when the volume of the cylinder area is increasing. On the returning "up stroke" or the portion of the stroke when the volume of the cylinder area is decreasing, the fluids will be forced out the cylinder through another valve. This can happen on a cylinder or any number of cylinders. A triplex pump is one with three cylinders and is a very common combination in oilfield operations.

As the piston moves up and down due to the rotation of the crankshaft, the up and the down position of the piston are typically very well defined. This means that the pump will pump a very predictable volume of fluid, or will have a positive displacement for each rotation of the crankshaft.

When the pump is driven by a single speed electric motor, the total volume pumped will simply be the positive displacement for each rotation of the crankshaft times the number of revolutions per minute.

There are occasions when it is desirable to have different flow rates from the pump. This is conventionally achieved by getting a variable speed motor or by having intermediate components which change the single speed of a motor to a variable speed for the pump. The variable speed motor always seems like a simple solution, but especially in high horsepower applications and applications in explosive environments the motors become very expensive.

The intermediate components to achieve variable flow also tend to be complex. One solution is to install a gear box, but this is complex and can require that the system be stopped to change gears. Alternately a variable displacement hydraulic pump and a hydraulic motor can be installed between the electric motor and the triplex pump. This is space consuming, expensive and prone to need maintenance.

SUMMARY OF THE INVENTION

The object of this invention is to provide a piston type pump which has a variable displacement at a given revolutions per minute speed.

A second object of the present invention is to provide a piston type pump on which the pressure differential between the piston area and the crankshaft area is shared among a number of individual seals.

A third object of the present invention is to provide an extension of the inlet check which causes a circulation of cooling water within the piston to cool the piston seals.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
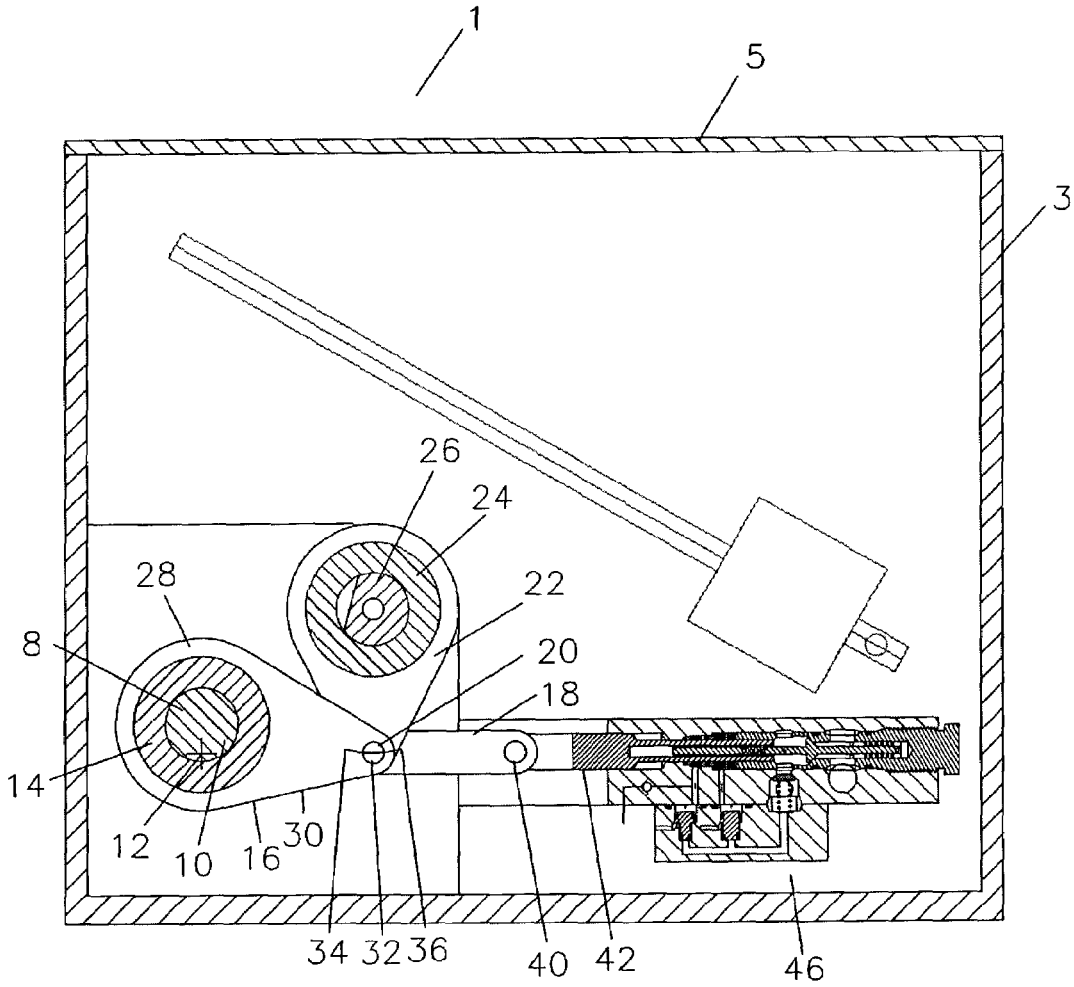
FIG. 1 is a section of the pump of this invention while pumping and the piston at mid stroke.

FIG. 1 shows pump 1 with a housing 3 and a lid 5. A crankshaft 8 with a throw or eccentric portion 10 is shown which rotates about a center of rotation shown at 12. Bearings are shown at 14, a connecting rod at 16 and an intermediate link at 18. Connecting pin 20 connects connecting rod 16 to intermediate link 18, and also connects wag rod or second link 22 to the connecting rod 16 and the intermediate link 18. Wag rod or second link 22 rotates about bearings 24 which are mounted on shaft 26 which has a fixed axis of rotation.

When the crankshaft 8 rotates about the center of rotation 12, the eccentric location of the throw 10 causes the bearing 14 and therefore the end 28 of the connecting rod 16 to move in a circular fashion. Because of the connection to pin 20 and the wag rod or second link 22, the connecting pin 20 and therefore the end 30 of the connecting rod 16 are constrained to move about the locus of points indicated at 32 between ends 34 and 36.

The movement of connecting pin 20 along the path indicated at 32 is transmitted to pin 40 which moves piston 42 a corresponding distance within cylinder head 46.

Figure 2:
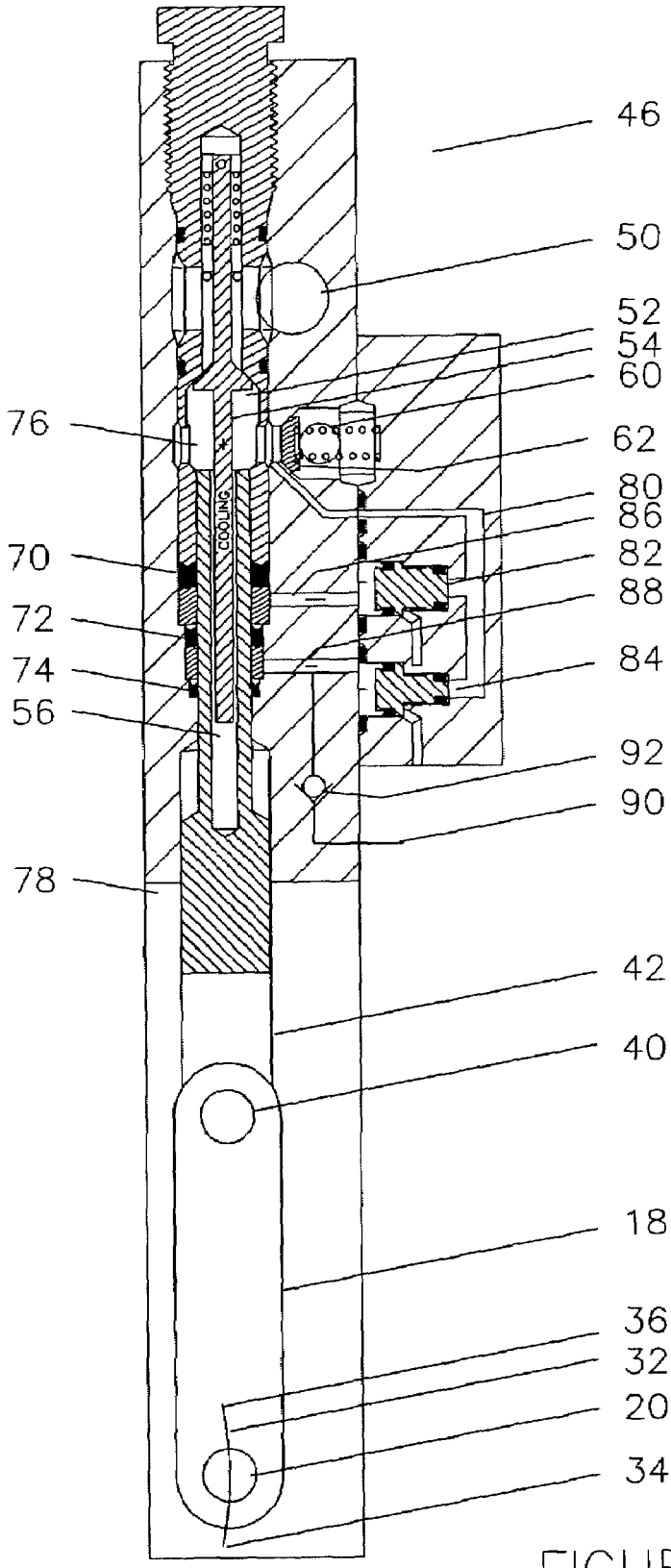
FIG. 2 is a section of the pump cylinder head enlarged for details.

Referring now to FIG. 2, an enlarged view of the cylinder head 46 is shown with an inlet port 50, and inlet check valve 52, and an inlet check valve extension 54. The inlet check valve extension 54 partially fits within a recess 56 of the piston 42 to cause circulation of the fluid being pumped into the top of piston for cooling. Outlet port 60 is provided with outlet check valve 62.

A multiplicity of piston seals 70, 72, and 74 are provided for sealing between the high pressure differential between the pumping chamber 76 and the atmosphere at 78. The intermittent high pressure in the pumping chamber 76 is communicated along hole 80 to the back of compensating pistons 82 and 84 which have differing pressure areas on opposite ends. The pressure areas of the compensating pistons are manufactured to deliver ⅔ of the chamber 76 pressure to the area between seals 70 and 72 via port 86 and ⅓ of the chamber 76 pressure to the area between seals 72 and 74. In this manner each of the seals 70, 72, and 74 are only required to withstand the wear and stress of ⅓ of the full differential of the pressure pumping chamber 76, thereby extending the service life of the seals.

Port 90 is shown connecting to port 88 through a check valve. Port 90 is supplied with a constant low pressure supply of fluid to make sure that an operational amount of liquid is in port 88 at all times. A similar supply of liquid is provided for port 86 also.

Figure 3:
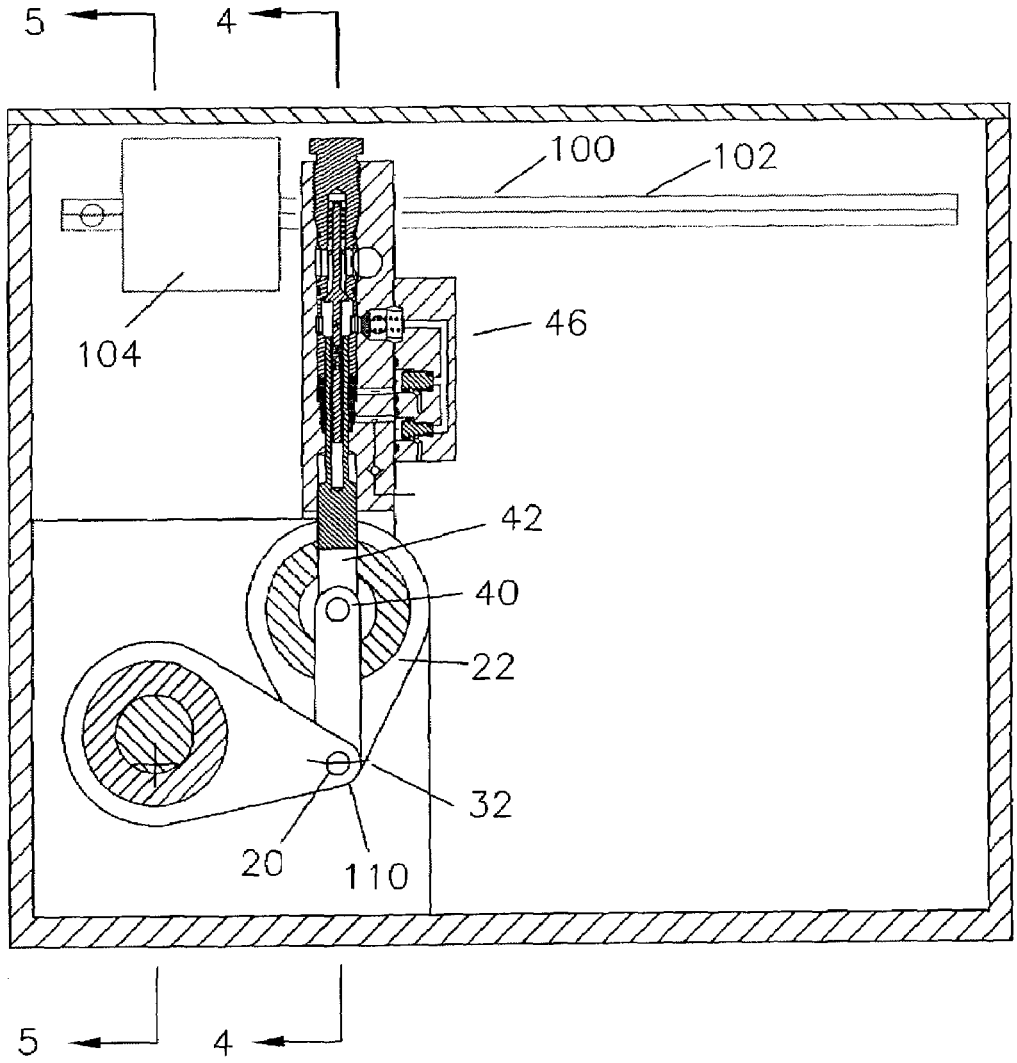
FIG. 3 is a section of the pump of this invention with the cylinder head rotated 90 degrees to the non-pumping position.

Referring now to FIG. 3, the cylinder head 46 has been rotated through a 90° arc by a mechanical or hydraulic means illustrated by the ball screw 100. The ball screw 100 is comprised of a long screw 102 and a ball housing 104. Rotation of the ball housing 102 will cause its translation, and with attachment to the cylinder head 46, it will cause the cylinder head 46 to be pivoted about a center at 110. The center 110 is manufactured to be at the center of the path 32 as indicated above. The centerline of one end of the wag rod or second link 22 and the intermediate link 18 will be in the same place due to common connection of pin 20, and the centerline of the other end of the wag rod or second link 22 and the intermediate link 18 will be in the same place due to the 90° movement. At this time as the crankshaft 8 rotates and the connection pin 20 moves along the path 32, the pin 40 and therefore the piston 42 do not move at all. Even though the motor is driving the crankshaft at a high rate of speed, there is no pumping occurring. We have changed the pump from a full flow rate in FIG. 1 to a no flow rate in FIG. 3. Any position between the position of FIG. 1 and the position of FIG. 3 will yield a varying output, depending on the angle. In this way, by varying the angle of the cylinder head 46, we can vary the flow of the pump.

Figure 4:
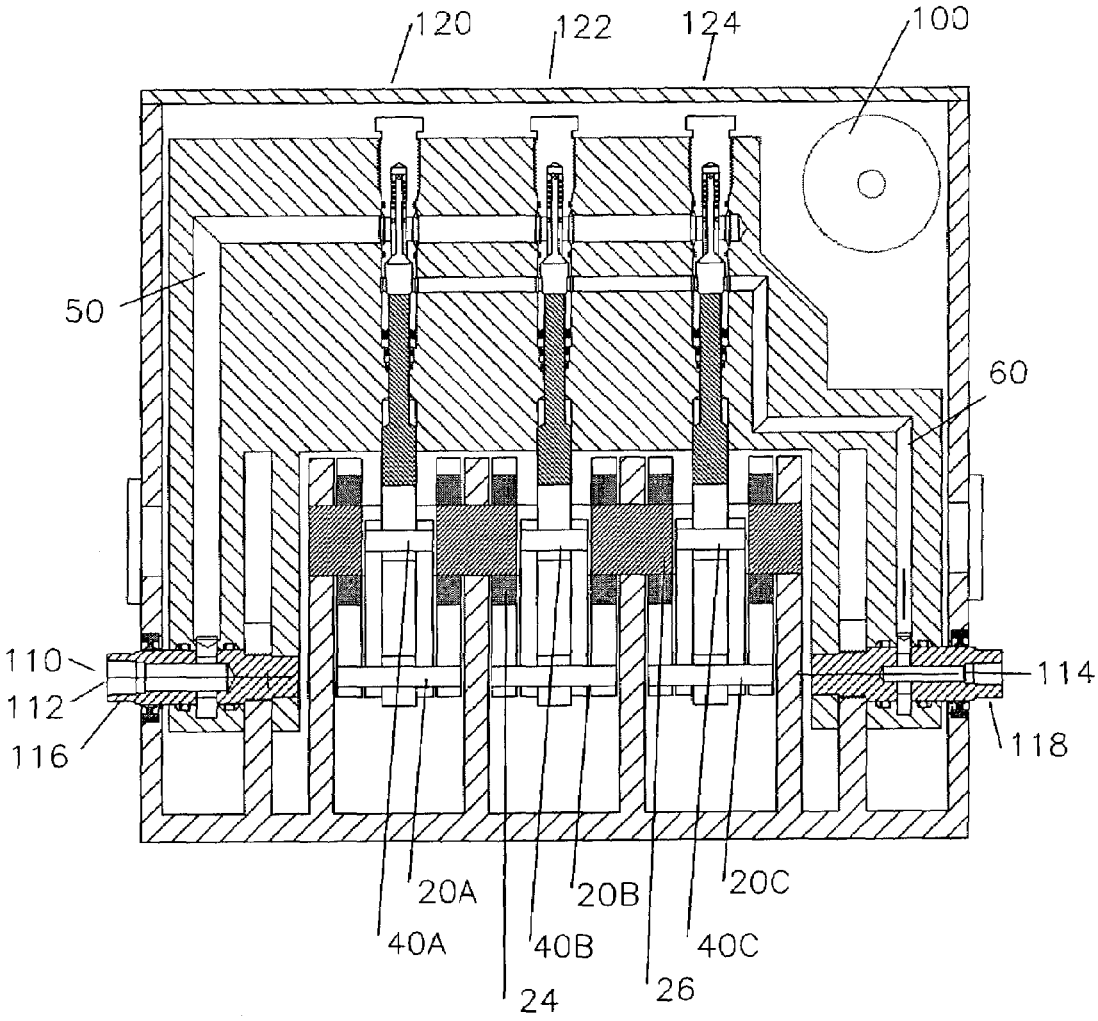
FIG. 4 is a section of the pump of this invention at 90 degrees to the section of FIG. 3.

Referring now to FIG. 4 which is section "4—4" from FIG. 3, center 110 is shown as centerlines 112 and 114 of swivels 116 and 118 respectively. Swivel 116 is the inlet swivel from the supply tank and swivel 118 is the high pressure outlet swivel. In the position as shown in FIG. 3 in mid stroke, the connecting pin 20 shown here as pins 20A, 20B, and 20C is concentric with the centerlines 112 and 114. In reality, only one of pins 20A, 20B, and 20C will be concentric with the centerlines at any time. The other two would be either in a position into or out of the page. Pin 40 shown here as pins 40A, 40B, and 40C are concentric with shaft 26. In this configuration, pins 20A, 20B, and 20C can reciprocate into and out of the plane of the page without causing any movement of pins 40A, 40B, and 40C or any flow from the attached pistons. The movement of wag rod or second link 22 is somewhat like a dog wagging its tail, hence the name wag rod.

Three separate piston/cylinder combinations are shown, making the unit a triplex pump. Any number of cylinders can be used to supply the appropriate flow rates.

Figure 5:
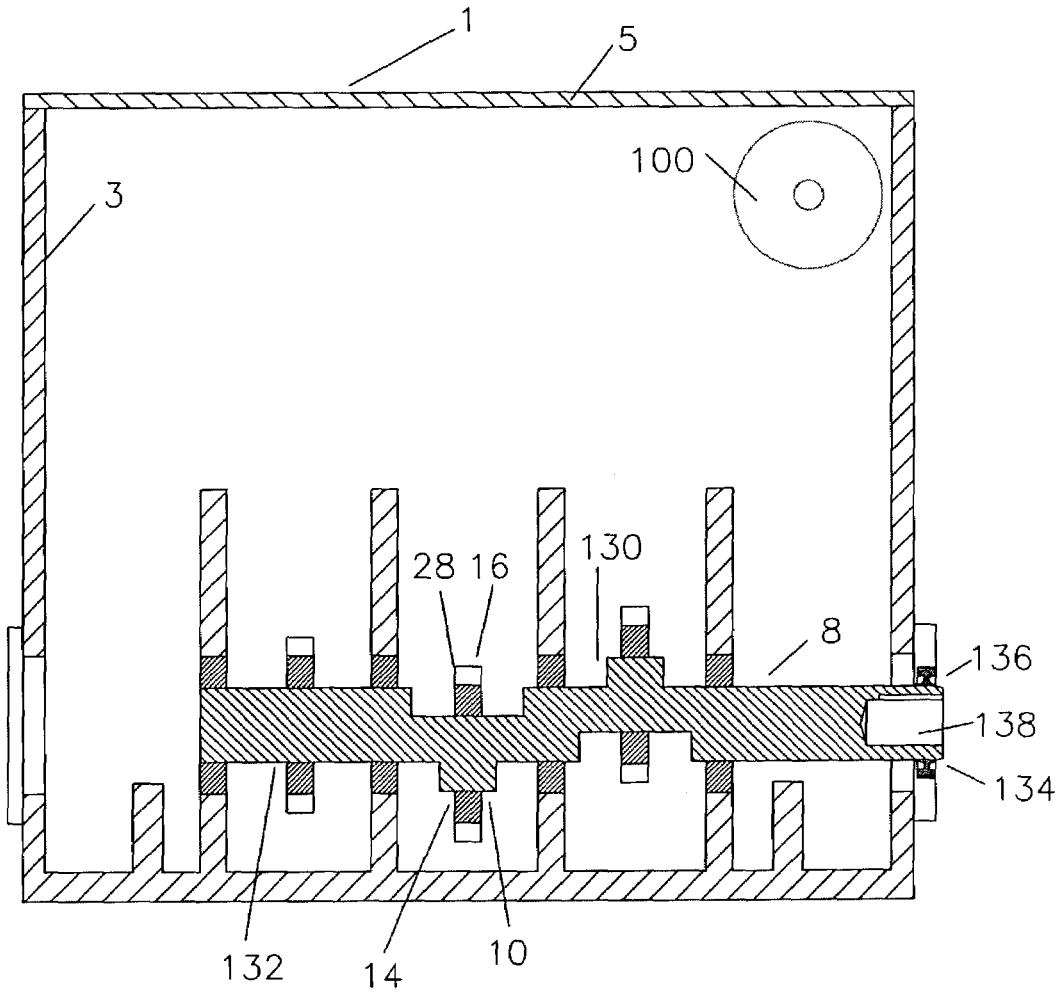
FIG. 5 is a section of the pump of this invention through the crankshaft.

Referring now to FIG. 5, a section "5—5" from FIG. 3 is shown through the crankshaft with the eccentrics visible at 10 and 130. At 132, the eccentric will exist, but the position of the throw is drawn at the midpoint and is not visible at this point in the rotation. End 134 of the crankshaft 8 is shown going through seal 136 and has preparation 138 for receipt of a single speed motor for rotational power.

The preferred embodiment discussed has the piston and head rotating about a centerline to allow for variation in the flow rate. In like manner, the piston and head portion can remain stationary and the crankshaft area can be rotated to achieve the same results.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. A method of providing variable pumping rate from a piston type pump at a constant drive speed, comprising:

providing a connecting rod connected to the throw of a crankshaft on one end and to a connecting pin on the other end, constraining said connecting pin to move reciprocally generally in a first direction when said crankshaft rotates, a piston connected to said connecting pin which is mounted in a head and moves reciprocally in a second direction, and varying the angle between said first direction and said second direction to vary the volume being pumped by said pump.

2. The method of claim 1, further comprising said piston is connected to said connecting pin by being connected to an intermediate link of a first length which is connected to said piston.

3. The method of claim 2, further comprising a second link connected to said connecting pin of approximately said first length and mounted in a position approximately perpendicular to the reciprocal movement of said connecting pin.

4. The method of claim 3, further comprising varying said angle between said first direction and said second direction by rotating said piston and said head about a centerline.

5. The method of claim 3, further comprising having proximately no flow from said pump when the center of rotation of said second link proximately coincides with the centerline of said connecting link which connects said intermediate link to said piston.

6. The method of claim 4, further comprising incorporating an inlet flow swivel on the centerline of rotation of said piston and said head.

7. The method of claim 4, further comprising incorporating an outlet flow swivel on the centerline of rotation of said piston and said head.

8. The method of claim 1, further comprising a multiplicity of seals around said piston which each share a portion of the differential pressure between the piston area and the ambient pressure.

9. The method of claim 8, further comprising forcing the fluid being pumped to circulate within a recess within said piston to carry seal friction heat away from the piston seals.

10. A method of providing variable pumping rate from a piston type pump at a constant drive speed, comprising:

providing a connecting rod connected to the throw of a crankshaft on one end and to a connecting pin on the other end, constraining said connecting pin to move reciprocally generally in a first direction when said crankshaft rotates, a piston connected to said connecting pin which is mounted in a head and moves reciprocally in a second direction, said piston is connected to said connecting pin by being connected to an intermediate link of a first length which is connected to said piston, a second link connected to said connecting pin of approximately said first length and mounted in a position approximately perpendicular to the reciprocal movement of said connecting pin, and varying said angle between said first direction and said second direction by rotating said piston and said head about a centerline.

11. The method of claim 10, further comprising having proximately no flow from said pump when the center of rotation of said second link proximately coincides with the centerline of said connecting link which connects said intermediate link to said piston.

12. The method of claim 11, further comprising incorporating an inlet flow swivel on the centerline of rotation of said piston and said head.

13. The method of claim 11, further comprising incorporating an outlet swivel on the centerline of rotation of said piston and said head.

14. The method of claim 10, further comprising a multiplicity of seals around said piston which each share a portion of the differential pressure between the piston area and the ambient pressure.

15. The method of claim 14, further comprising forcing the fluid being pumped to circulate within a recess within said piston to carry seal friction heat away from the piston seals.

16. A method of providing variable pumping rate from a piston type pump at a constant drive speed, comprising:

providing a connecting rod connected to the throw of a crankshaft on one end and to a connecting pin on the other end, constraining said connecting pin to move reciprocally generally in a first direction when said crankshaft rotates, a piston connected to said connecting pin which is mounted in a head and moves reciprocally in a second direction, and varying the angle between said first direction and said second direction to vary the volume being pumped by said pump such that when said first direction and said second direction are proximately parallel a maximum flow rate is achieved and when said first direction and said second direction are proximately perpendicular a minimum flow rate is achieved.

17. The method of claim 16, further comprising said piston is connected to said connecting pin by being connected to an intermediate link of a first length which is connected to said piston.

18. The method of claim 17, further comprising a second link connected to said connecting pin of approximately said first length and mounted in a position approximately perpendicular to the reciprocal movement of said connecting pin.

19. The method of claim 17, further comprising varying said angle between said first direction and said second direction by rotating said piston and said head about a centerline.

20. The method of claim 17, further comprising having proximately no flow from said pump when the center of rotation of said second link proximately coincides with the centerline of said connecting link which connects said intermediate link to said piston.

21. The method of claim 19, further comprising incorporating an inlet flow swivel on the centerline of rotation of said piston and said head.

22. The method of claim 19, further comprising incorporating an outlet flow swivel on the centerline of rotation of said piston and said head.

23. The method of claim 16, further comprising a multiplicity of seals around said piston which each share a portion of the differential pressure between the piston area and the ambient pressure.

24. The method of claim 23, further comprising forcing the fluid being pumped to circulate within a recess within said piston to carry seal friction heat away from the piston seals.

* * * * *